US007284638B1

(12) United States Patent
Sahyoun

(10) Patent No.: US 7,284,638 B1
(45) Date of Patent: Oct. 23, 2007

(54) LOUDSPEAKER LOW PROFILE QUARTER WAVELENGTH TRANSMISSION LINE AND ENCLOSURE AND METHOD

(76) Inventor: Joseph Y. Sahyoun, 3031 Hopkins Ave., Redwood City, CA (US) 94062

( * ) Notice: Subject to any disclaimer, the term of this patent is extended or adjusted under 35 U.S.C. 154(b) by 0 days.

(21) Appl. No.: 11/430,351

(22) Filed: May 8, 2006

(51) Int. Cl.
*G10K 11/00* (2006.01)

(52) U.S. Cl. ..... 181/156; 181/193; 181/279

(58) Field of Classification Search ..... 181/156, 181/193, 279
See application file for complete search history.

(56) References Cited

U.S. PATENT DOCUMENTS 1,836,222 A * 12/1931 Bonine ..... 181/193
3,687,221 A * 8/1972 Bonnard ..... 181/180
3,917,024 A * 11/1975 Kaiser, Jr. ..... 181/163
3,923,124 A * 12/1975 Hancock ..... 181/156
5,751,827 A * 5/1998 Takahashi ..... 381/190
6,425,456 B1 * 7/2002 George ..... 181/199
6,634,455 B1 * 10/2003 Yang ..... 181/156
6,648,098 B2 * 11/2003 Nichols ..... 181/193
6,973,994 B2 * 12/2005 Mackin et al. ..... 181/156
7,051,835 B2 * 5/2006 Martikainen ..... 181/156

* cited by examiner

*Primary Examiner*—John R. Lee
(74) *Attorney, Agent, or Firm*—Allston L. Jones

(57) ABSTRACT

A speaker enclosure including a compact quarter wavelength transmission path in the shape of a closed spiral that expands radially outward from a centrally located loudspeaker mounting location. The height of the transmission path has a minimum height that is equal to the height of the basket of the desired speaker. The quarter wavelength transmission path spiral of the provides an aerodynamic path for air flow therein which reduces the turbulence of air flow to a minimum that in turn provides even resistance to the air flow within the transmission line (Exhale vs. Inhale).

18 Claims, 7 Drawing Sheets

LOUDSPEAKER LOW PROFILE QUARTER WAVELENGTH TRANSMISSION LINE AND ENCLOSURE AND METHOD

BACKGROUND OF THE INVENTION

1. Field of the Invention

The present invention relates to speaker systems that employ a quarter wavelength acoustic standing wave transmission line in combination with a speaker. More particularly, loudspeakers with a compact quarter wavelength transmission line and design methods associated with them.

2. Description of the Prior Art

Enclosures have been used with loudspeakers not simply to improve the appearance and decorative appearance of the speaker. Without a speaker enclosure any sound waves emanating from the rear of the speaker that are out of phase with the desired sound waves from the front of the speaker can create interference patterns and can cause cancellation of some frequencies in the desired sound waves. This can be a major problem at lower frequencies where the wavelengths are longest. It has been noted that at the lower frequencies the interference from sound waves from the back of the speaker can affect an entire listening area.

One technique to reduce the interference from the rear of the speaker is providing a transmission line of a selected length coupled to the back of speaker to shift the phase of the output from the rear of the speaker by 90° to 270° to reinforce the output from the front of the speaker. In this technology the speaker is often referred to as a driver as the speaker is said to drive the transmission line. The transmission line is a hollow enclosed path with a length that is a multiple of the quarter wavelength of the primary frequency that interferes with the desired sound frequencies produced by the front of the loudspeaker. Since lower frequencies have the longest wavelengths, low frequency speaker systems that incorporate such a transmission line tend to be larger than other types of woofer and sub-woofer designs. The size of the transmission line and speaker configuration is dictated by the wavelength of the frequency to be compensated. Given the long wavelength of the sound frequencies, the length of the transmission line is generally one-quarter the wavelength of a frequency in the output range of the specific woofer or sub-woofer speaker, thus speaker systems with these transmission lines are typically referred to as quarter wavelength speakers.

Prior art quarter wavelength speakers used a conventional enclosure that was generally a cube or rectangular in shape with the transmission line, in this technology also referred to as a port, internal to such an enclosure requiring the transmission line or port to take the shape of an "elephant's trunk" to provide the necessary length of the port. For those designs the enclosure volume relative to the port volume compromised the performance as the necessary shape of the port contributed to the non-linearity developed since the air resistance of the port (inhale vs exhale) are different. That difference was related to the turbulent flow developed when the speeding air particles collided with sharp corners (enclosure walls and the speaker-port mating area within the enclosure). Another problem of the prior art is the inconvenience of creating the "elephant's trunk" design in a traditional speaker enclosure. Such speakers put the aesthetics of the enclosure having a particular ratio of height, width and depth ahead of the port shape needed to maximize performance of the speaker system thus forcing the port into an "elephant's trunk" shape, or worse. In an effort to control harmonic distortions with the use of an aesthetic enclosure, the port was designed to have a variable cross-section throughout its length to control the level of harmonic distortions that resulted in the requirement to use such enclosures. This only introduced detrimental side effects, such as driver offset that worsened harmonics.

For 56 Hz, given the speed of sound in air being approximately 1130 ft./sec, a single 56 HZ wave has a wavelength of 240 inches, i.e. 20 feet long, thus a quarter wavelength of 56 HZ has a length of 60 inches, i.e. 5 feet. Thus, considering only wavelength, the port would have to be 60 inches long. However, do to other factors than just the wavelength of the selected frequency, a prior art example of a tubular port with a port length of 60 inches the tuning frequency was measured at 39 Hz. Thus, considering only wavelength, the resonance tuning frequency was about 30% lower than expected. It was then determined that the cross sectional area of the port perpendicular to the moving air mass in the port is another factor needed to be considered in the determination of the necessary length of the port for a particular frequency. It was determined that as the diameter of the tubular port is increased there is a larger moving mass of air which lowers the resonance frequency of the tubular port. Another issue with the quarter wavelength designs of the prior art is extremely high harmonic distortions. It was determined that harmonic distortion was related to the cross sectional area of the port and the peak pressure in the port. In addition these harmonics were noted to also be related to the wind velocity in the port, typically wind velocities that exceed the speed of sound by as little as 2% (i.e., 22.5 feet/second).

Two prior art examples of quarter wavelength speakers are described in U.S. Pat. No. 6,425,456 by Jacob George entitled "Hollow Semicircular Curved Loudspeaker Enclosure" issued Jul. 30, 2002 and U.S. Pat. No. 6,634,455 by Yi-Fu Yang entitled "Thin-Wall Multi-Concentric Sleeve Speaker" issued Oct. 21, 2003.

The George patent ('456) illustrates the port in the "elephant's trunk" shape that curls in on itself. In George's design the proximate end of the port has a diameter that is as large as, or larger than, the diameter of the driver with that diameter remaining unchanged for some distance from the driver before turning a corner into a smaller diameter section and then yet smaller diameters in each of the next three turns in the path of the port before opening into a bifurcated output end of the port.

The Yang patent ('455) illustrates in FIGS. 1 and 4 the port as what can be seen to be a cylinder within a cylinder within a cylinder. In his FIG. 1 the output of speaker 12 opens directly into the listening area, while the back of the speaker opens into a first portion of the port that is a large enclosed area that is much larger than the diameter of the speaker and then into a second portion of the port that has a diameter that is considerably larger than the diameter of the speaker with the third and forth portions of the port each having a smaller cross-sectional area than the preceding portion of the port. Each of the transitions from the second to the third, and the third to the fourth portions of the port requires a 180° reversal of the air mass in the port as the air mass transitions from a lower pressure portion of the port to a higher pressure portion of the port each time the path of the port transitions to the next cylinder as the path of the port progresses outward with each of those transitions creating turbulence in the air mass. Additionally, the bottom of the second cylinder is separated from the bottom of the enclosure thus permitting some of the air mass from the fourth portion of the port to collect beneath the second cylinder thus causing yet additional turbulence in the air mass just before exiting the bottom of the enclosure.

Yang, in his FIG. 4, shows an alternative design which is substantially the design of FIG. 1 turned upside-down with the front of the speaker facing the floor with the back of the speaker driving the air mass into the outermost cylinder port and then progressing inward through additional cylinder with a 180° transition between each of them and terminating a large diameter center cylinder that opens to the top into the surrounding atmosphere. This design has similar turbulence problems to those of his FIG. 1 design, plus an added problem. With the top end of the speaker facing the floor and opening to the surrounding atmosphere through the small space below the speaker enclosure, there is a back pressure on the front of the cone of the speaker that is emitting what should be the desired audio signal that is being compensated for by the transmission line. That back pressure is caused by two factors: one is the reflected sound waves from the floor, and the second in the restrictive small space beneath the speaker enclosure that acts as a second transmission line. That second transmission line can change the frequency that is desired to another frequency before being delivered to outer atmosphere in the listening area. Additionally, that back pressure on front of the speaker changes the movement pattern of the speaker cone and thus modifies the air flow through the cylinders of the transmission line which changes the frequency response of the transmission line from the desired response to an unknown response.

The present invention neither looks like the example designs, or any other design that the applicant has seen. Additionally, the present invention was not designed to fit some preselected enclosure, but rather the design of the transmission line defines the enclosure. Thus, as will be realized in the discussion below of the present invention and from the figures, that the present invention is hot a "make fit" design as is the prior art.

SUMMARY OF THE INVENTION

The present invention includes a compact quarter wavelength transmission path in the shape of a closed spiral that extends radially outward from a centrally located loudspeaker mounting location. The height of the transmission path has a minimum height that is equal to the height of the basket of the desired speaker. The quarter wavelength transmission path spiral of the present invention provides an aerodynamic path for air flow therein which reduces the turbulence of air flow to a minimum that in turn provides even resistance to the air flow (Exhale Vs Inhale).

The present invention includes an acoustic enclosure that has a bottom portion with a substantially flat interior bottom surface with a wall of a selected height affixed thereto and that is substantially perpendicular to the interior bottom surface wherein the wall has a first end spaced a first selected distance from a central point on the bottom surface with the wall spiraling outward from the first end at a controlled increasing radius from the central point in consecutive loops of the spiral being spaced apart from each other by a selected distance at each point in the spiral defining a path between the consecutive loops of the spiral to create the wall with a selected length having a second end that is the greatest distance point of the wall from the central point. The outer side wall of the enclosure being the outer most 360° portion of the wall. To provide closure, the enclosure also includes a top portion affixed to the top edge of the wall. The top portion also has a central opening defined therethrough above the central point on the interior bottom surface and an area therearound substantially within the first selected distance from the central point when in place.

The present invention is also the method of making an acoustic enclosure by; selecting a bottom surface; affixing a wall of a selected height to, and that is substantially perpendicular to the bottom surface wherein the wall has a first end spaced a first selected distance from a central point on the bottom surface with the wall spiraling outward from the first end with a controlled increasing radius from the central point in consecutive loops of the spiral being spaced apart from each other by a selected distance at each point in the spiral defining a path between the consecutive loops of the spiral to create the wall with a selected length having a second end that is the greatest distance point of the wall from the central point with the outer side of the enclosure formed by the outer most 360° portion of the wall; shaping a top portion to be affixed to a top edge of the wall; defining a central opening in the top portion to be positioned above the central point of on the bottom surface and an area therearound substantially within the first selected distance from the central point; and affixing the top surface to the top edge of the wall.

The quarter wave speaker enclosure of the present invention is designed to receive a speaker with the axis of movement of the center of the cone oriented perpendicular to the outward expanding radius of the spiral shaped transmission tunnel which yields an enclosure that has a height that is slightly taller than the height of the basket of the speaker that is to be used with the enclosure. With the easy availability of low profile woofer speakers, the quarter wave speaker enclosure of the present invention can have an overall height of only a few inches which cannot be said for the prior art enclosures even if they incorporate a low profile speaker. Additionally, since the enclosure of the present invention is dictated by the shape of the transmission line, the ratio of the volume of the enclosure in comparison to the volume of the air within the transmission line is approximately unity. Further, an enclosure of the present invention that is designed for use with a 12 inch diameter speaker that is compensated for 56 Hz, the maximum diameter of the enclosure is approximately 24 inches, or twice the diameter of the speaker since the diameter of the speaker and the enclosure are in the same plane.

DETAILED DESCRIPTION OF THE INVENTION

Figure 1:
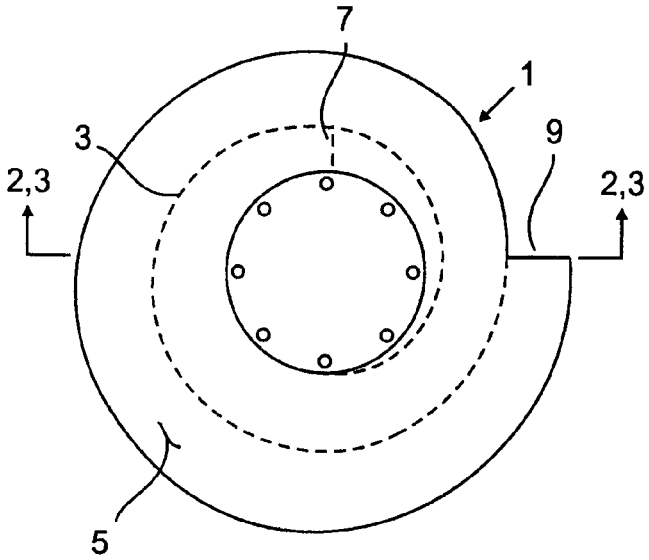
FIG. 1 is a simplified top plan view of a quarter wavelength transmission line of the present invention.

FIG. 1 shows a simplified top view of enclosure 1 that is configured substantially by the design of the enclosed quarter wavelength transmission line of the present invention. In the present invention the shape of the quarter wavelength transmission line determines the shape of the enclosure, the direct opposite of the prior art. The fact that the transmission line determines the enclosure shape one can think of the enclosure and the transmission line as being one and the same, thus reference number 1 may be used for both.

Figure 9:
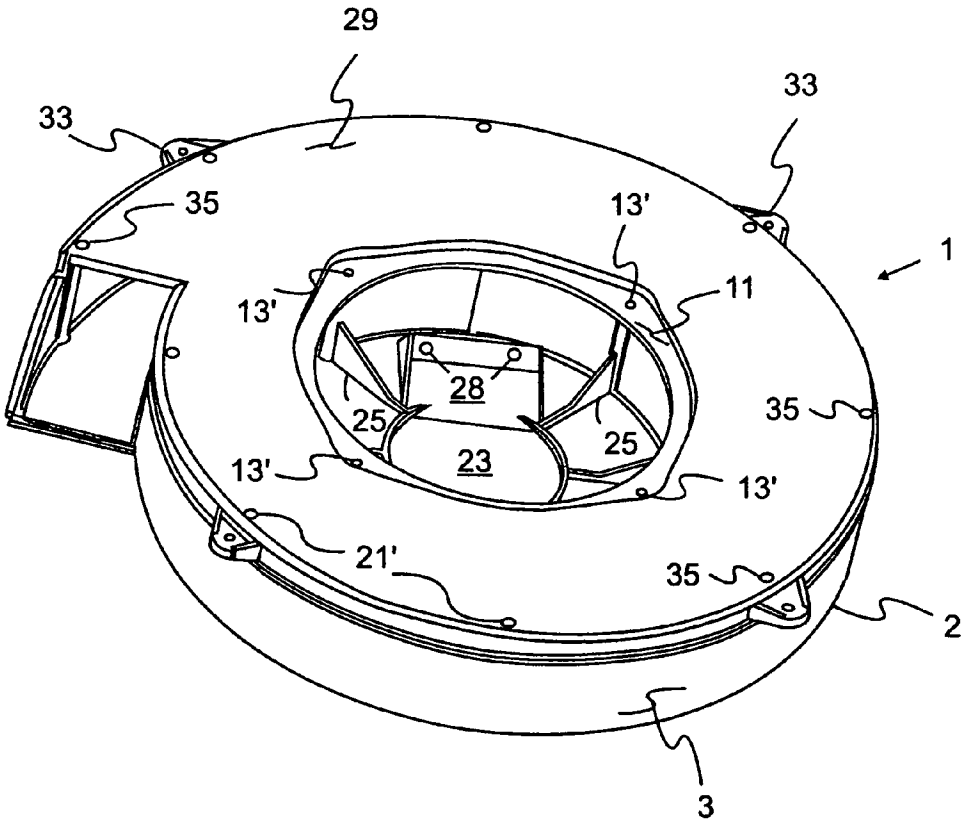
FIG. 9 is a perspective view of the assembled quarter wavelength transmission line of the first embodiment of the present invention.

FIG. 1 further shows transmission line tunnel wall 3 as a broken line for the covered portion and as a solid line for the outer most portion of the wall, to illustrate the interior spiral shaped tunnel 5 that defines the transmission line length. The input of tunnel 5 is illustrated by broken line 7 and the output by solid line 9 at the outer most end of tunnel 5. Center hole 11 in the top cover is the location through which the included speaker (see FIG. 2) will be placed and the output 9 are the only openings to the outside of transmission line 1 in the view of FIG. 1. The center of center hole 11 is also the point from which the expanding radius of the tunnel spiral is measured. Thus the center of the speaker (see FIGS. 2 and 3) and the point of radius measurement of the spiral are coincident. As will become clear from FIG. 9, FIG. 1 is also a simplified top view of the speaker enclosure of the present invention.

Figure 2:
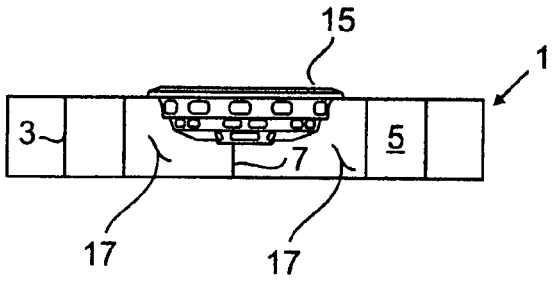
FIG. 2 is a simplified vertical cross-section, generally along line 2,3-2,3 as in FIG. 1, through the center of a first embodiment of a quarter wavelength transmission line of the present invention with a speaker shown in place.

FIG. 2 is a simplified vertical cross-section through the center of a first embodiment of quarter wavelength transmission line 1 of FIG. 1 with speaker 15 shown in place. It can also be seen in FIGS. 1 and 2 that enclosure 1 is of uniform height (see also FIG. 9) and in FIG. 2 that tunnel 5 is thus of substantially the same uniform height as enclosure 1 in the inner and outer most portions thereof. Additionally, in FIG. 2 it can be seen that tunnel 5 is of substantially the same width throughout (see also FIGS. 4*a* and 6*a*).

From FIGS. 1 and 2 one can see that region 17 is outside input 7 of tunnel 5 and partially beneath the top cover of transmission line 1 beside the basket of speaker 15, with region 17 also extending underneath speaker 15 as well, as can be seen in FIG. 2. The input 7 of tunnel 5 in the views of both FIGS. 1 and 2 is behind speaker 15 with region 17 being a continuous region and not divided into two portions as one might think when first viewing FIG. 2.

Figure 3:
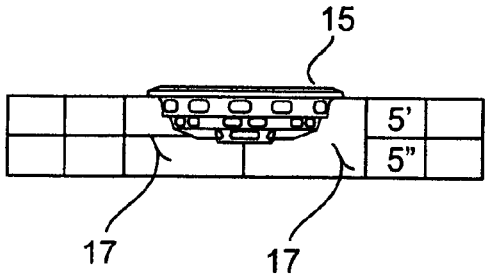
FIG. 3 is a simplified vertical cross-section, generally along line 2,3-2,3 as in FIG. 1, through the center of a second embodiment of the present invention with two identical quarter wavelength transmission lines, one on top of the other with a speaker shown in place.

FIG. 3 is a simplified vertical cross-section through the center of a second embodiment of quarter wavelength transmission line 1 of FIG. 1 with speaker 15 shown in place. The embodiment of FIG. 3 is similar to the first embodiment shown in FIG. 2 with tunnel 5 replaced by two half height tunnels 5' and 5", stacked one on the other. Both of tunnels 5' and 5" are the same length as each other and function together with the input of each tunnel open to region 17 beside and beneath speaker 15, and together are substantially the same size and shape as in the single tunnel configuration as in FIG. 2. As stated above in the Background section, in the cross sectional area of the port, or tunnel, perpendicular to the moving air mass needs to be considered in the determination of the necessary length of the tunnel for a particular frequency as it was determined that as the cross-sectional area of tunnel increases the resonance frequency of the port decreases. By using two or more stacked tunnels, each tunnel having a smaller cross sectional area than a tunnel having a larger cross-sectional area in an enclosure with the same external dimensions and same size speaker as an enclosure with a single tunnel, it might present an advantage in designing the quarter wavelength transmission line.

In each of FIGS. 2 and 3 it can be seen that region 17 is in communication with the entire basket of speaker 15, bottom and all around the side.

While the two embodiments illustrated in FIGS. 2 and 3 only show the use of a single tunnel, or two stacked tunnels, the number of tunnels could be increased to as many as desired for a particular application.

Figure 4B:
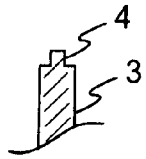
FIG. 4*b* is a cross-section of a portion of tunnel wall showing orientation projection on top edge thereof.
Figure 4A:
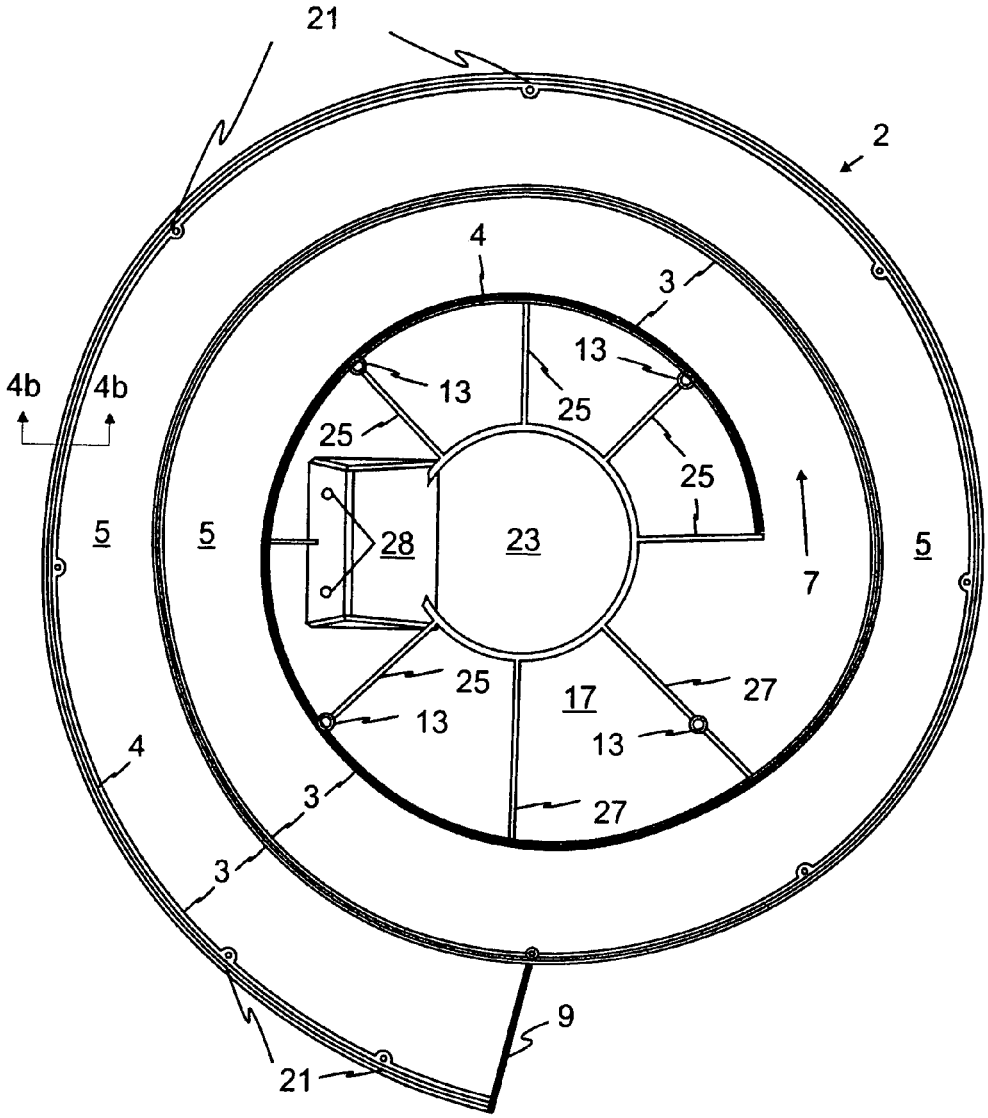
FIG. 4*a* is a top plan view of the quarter wavelength transmission line of the present invention with the top cover removed.
Figure 5:
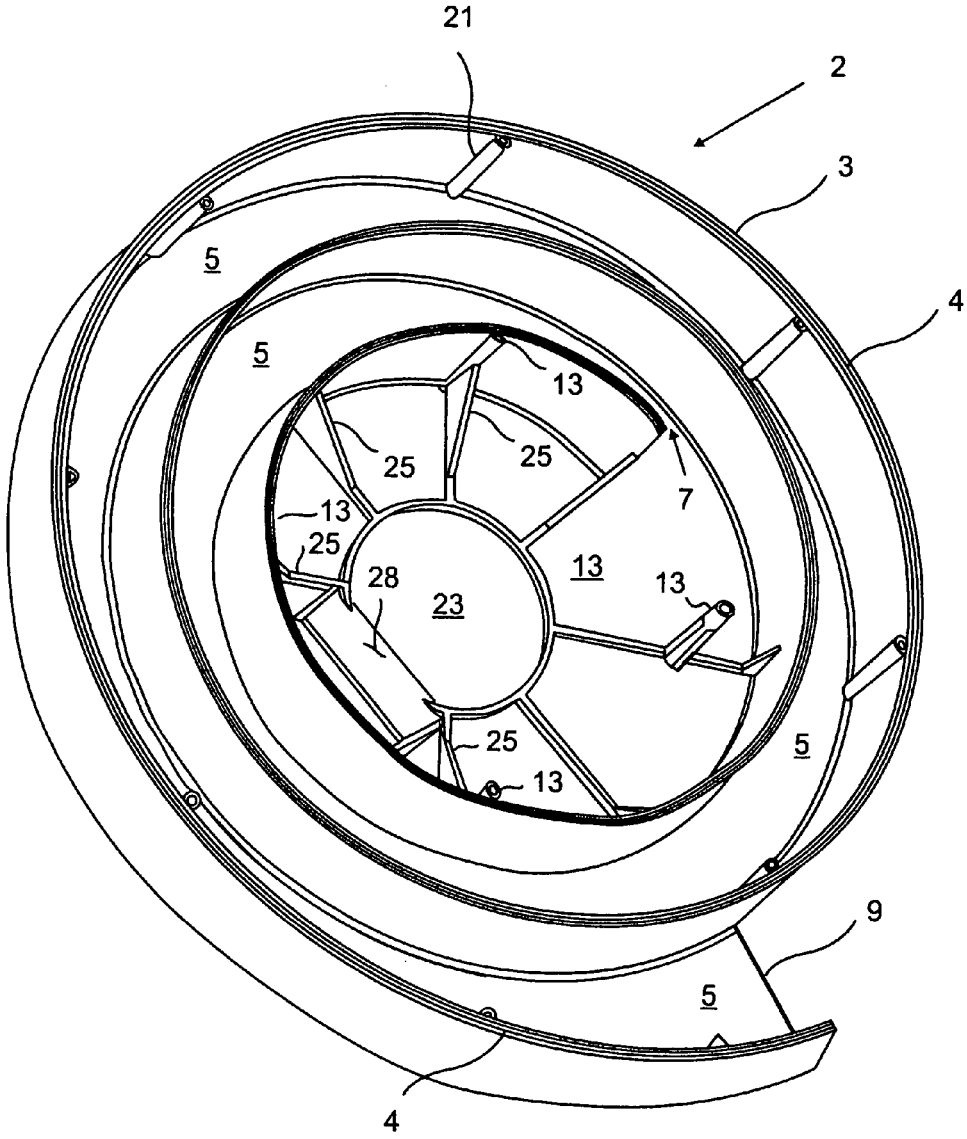
FIG. 5 is a perspective view of the quarter wavelength transmission line shown in FIG. 4*a;*

FIGS. 4*a* and 5 are top plan and perspective views, respectfully, of main body 2 of the quarter wavelength transmission line 1 of the first embodiment of the present invention. In FIG. 1, as in FIGS. 4 and 5, the direction of the spiral of tunnel 5 is shown expanding outward with a counter clockwise rotation however the direction in which the spiral expands, clockwise or counter-clockwise, is immaterial.

FIGS. 4*a* and 5 include top plate screw retaining posts 13 and 21. Retaining posts 21 each receive the distal end of a screw passed through corresponding mounting holes 21' in the top plate (see FIG. 6*a*) of transmission line 1. The four inner most retaining posts 13 in these views serve a dual purpose of retaining the speaker that will be enclosed by transmission line 1 and to receive screws through corresponding holes in the top plate. For retaining posts 13, they each receive the distal end of a screw that first passes through the mounting holes in the mouth of the speaker basket (not shown) then through the corresponding mounting holes in the top plate before passing into the corresponding retaining post 13. Thus the screws to mate with retaining posts 13 are not inserted until the speaker is in place. Additionally, in this example embodiment, there is shown center area 23 defined by a low height surrounding rib. Center area 23 can be spaced apart from, or receive, the bottom center of the basket of speaker 15. Surrounding center area 23, a group of ribs 25 and 27 are shown. In FIG. 5 ribs 25 are shown as triangular in shape sloping downward from the inner most portion of tunnel wall 3 toward center area 23. These provide additional strength to the inner most portion of tunnel wall 3 to minimize, or dampen, flexing of wall 3 during operation of the speaker in the enclosure, as well as cradling the lower portion of the speaker basket and to better position speaker 15. Speaker connection block 28 with two connection posts is shown to the left of center 23 with the posts extending through the bottom of main body 2. In the final assembly step of mounting speaker 15, wires from the connection points on the speaker basket are connected to post 28.

FIG. 4*b* is a cross-section of a portion of tunnel wall 3 of FIG. 4*a* with the details of the top edge of wall 3 with the orientation projection 4 on top edge thereof. Projection 4 is included on the top edge of tunnel wall 3 throughout the entire length thereof.

Figure 6B:
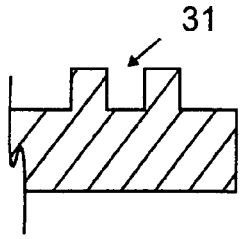
FIG. 6*b* is a cross-section of a portion of the top cover showing the detail of the orientation channel on the underside thereof.
Figure 6A:
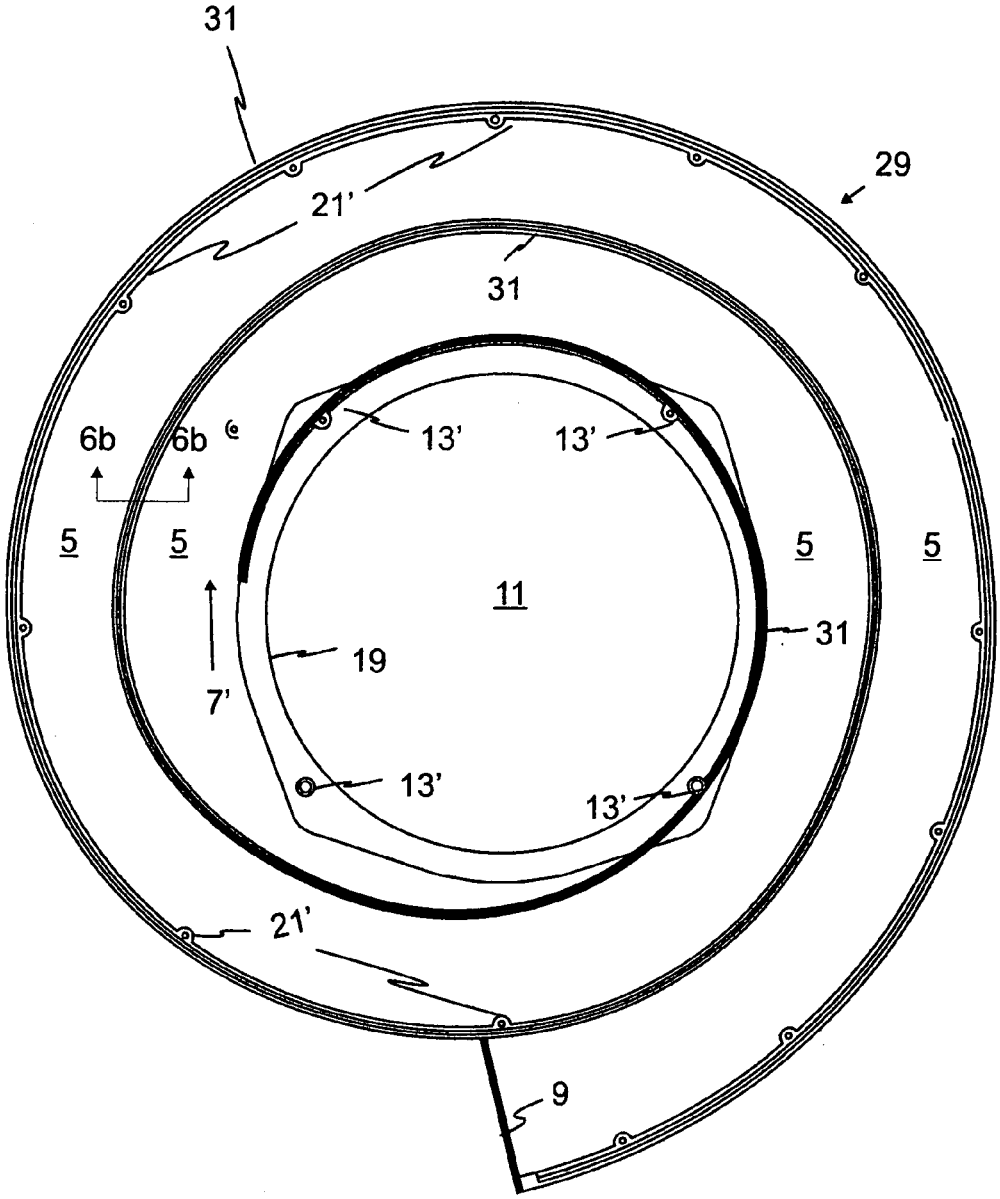
FIG. 6*a* is a simplified plan view of the underside of the top cover for the quarter wavelength transmission line of FIGS. 4*a* and 5.

FIG. 6*a* is a plan view of the underside of top plate 29 of quarter wavelength transmission line 1 that is configured to mate with the top edge of tunnel wall 3 of main body 2 shown in FIGS. 4*a* and 5. Shown in this view is a spiral shaped channel 31 (see detail in FIG. 6*b*) that is sized and shaped to mate with the orientation projection 4 (see FIG. 4*b*) on the top edge of the entire length of tunnel wall 3 (see FIGS. 4*a* and 5) to provide positive orientation and closure of top cover 29 with tunnel wall 3. While this is not a necessary part of the present invention, it will clearly improve the performance of the quarter wavelength transmission line of the present invention. By making a positive connection between the top of tunnel wall 3 and the bottom of top plate 29 a more air tight seal will be made throughout the entire length of the quarter wavelength tunnel 5. Alternatively, or perhaps additionally, a rubber seal could be attached to the top edge of tunnel wall 3 and/or in channel 31 on the under side of top plate 29 to make a more positive air seal between the two parts.

Additionally, holes 21' extend through top plate 29 and are positioned to mate with retaining posts 21 in main body 2 (FIGS. 4*a* and 5), similarly, holes 13' are positioned to mate with retaining posts 13 in main body 2 (FIGS. 4*a* and 5) with the surface of the underside the opening of holes 13' of top plate 29 in contact with the top of retaining posts 13. The speaker is placed in recess 19 (see FIGS. 8 and 9) with the holes in the mouth of the basket aligned with holes 13' in top cover 29 and the final assembly step is putting screws through the speaker holes, then extending through holes 13' into the top of retaining posts 13.

Figure 7:
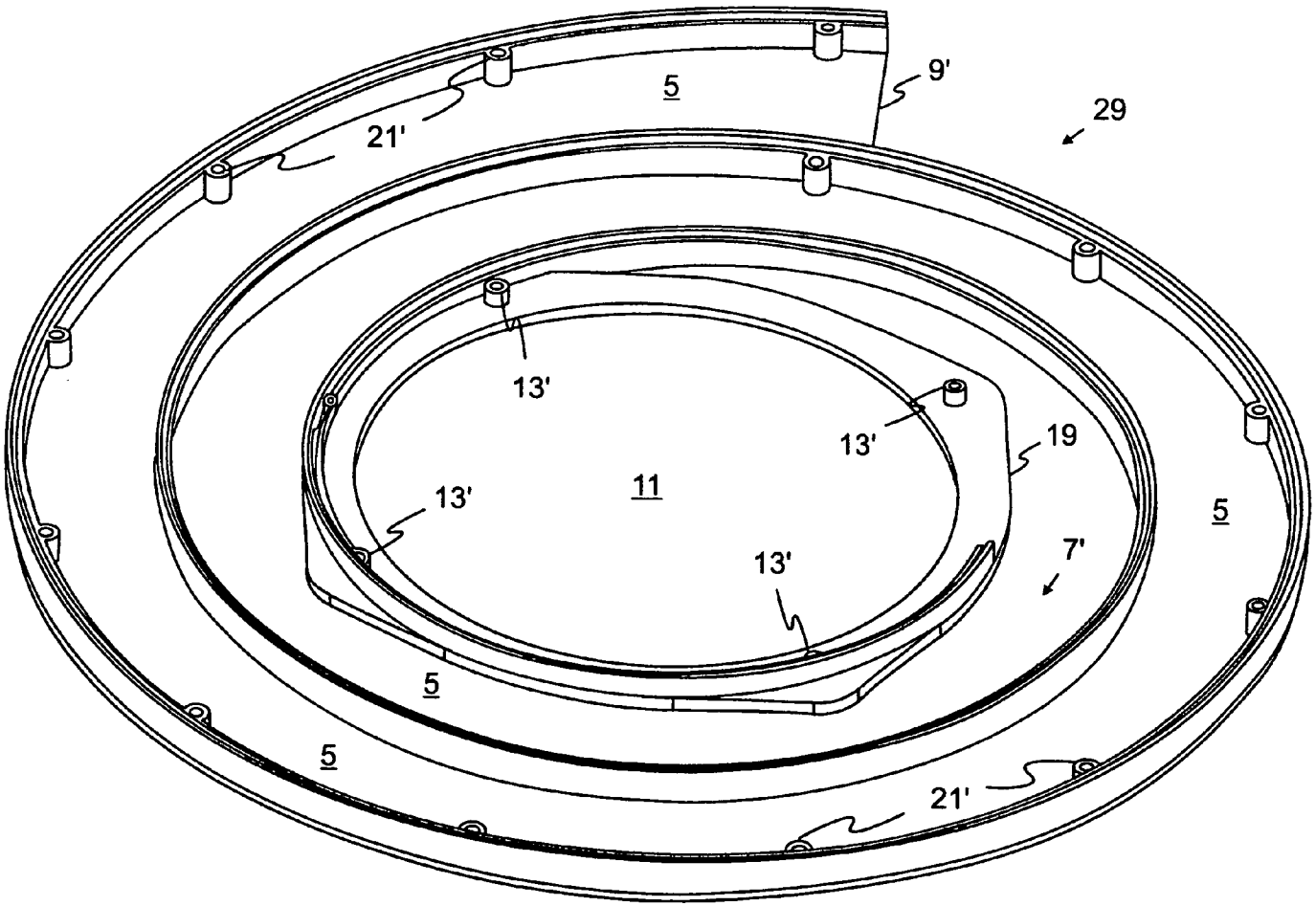
FIG. 7 is a simplified perspective view of the underside of the top cover for the quarter wavelength transmission line of FIG. 6*a;*

FIG. 7 is a perspective view of the underside of top plate 29 which more clearly shows recess 19 for receiving the mouth of the speaker and orientation channel 31. The remainder of the reference numbers in this view are the same as in FIG. 6*a* and previous figures for the same item.

Figure 8:
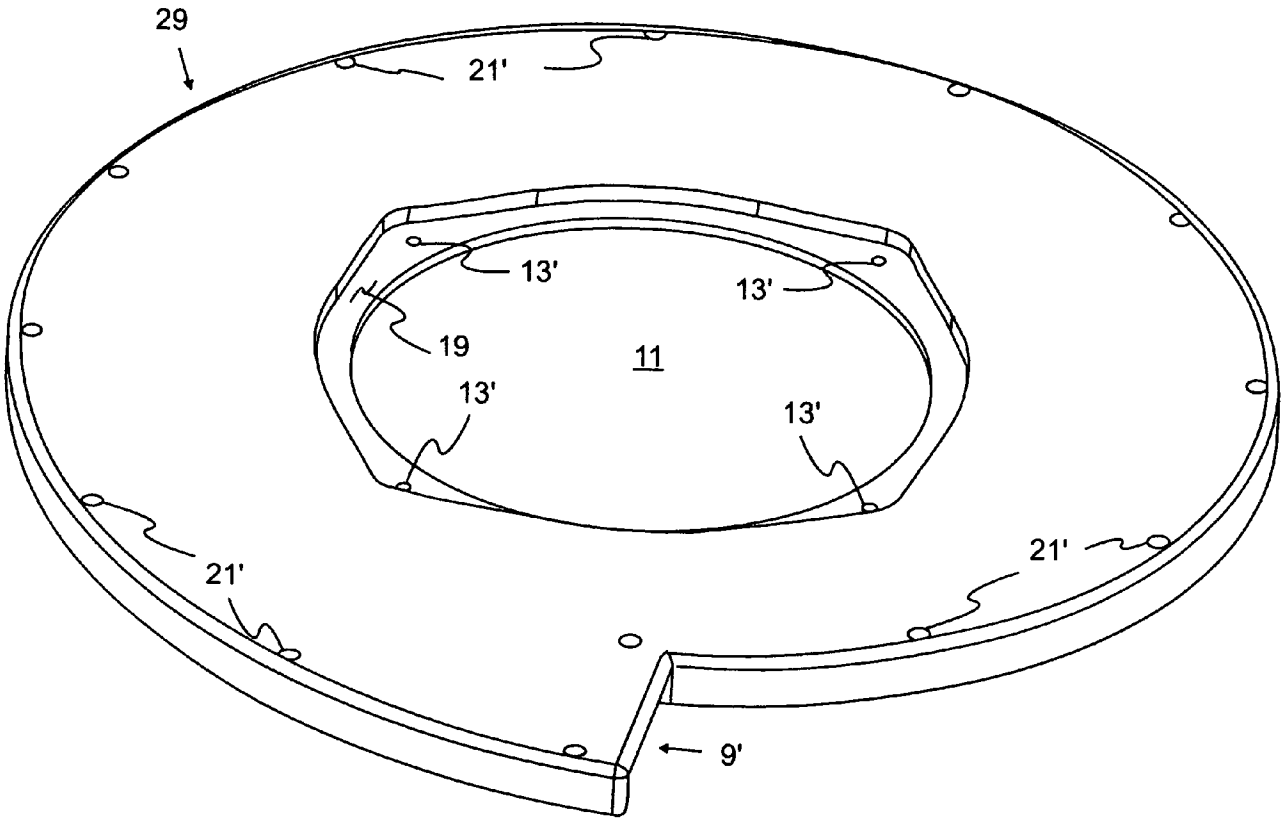
FIG. 8 is a simplified perspective view of the top side of the top cover for the quarter wavelength transmission line of FIGS. 6*a* and 7.

FIG. 8 is a perspective view of the top side of top plate 29 clearly showing screw holes 13' and 21' and recess 19 disposed to receive the bottom edge of the mouth of speaker 15 with the remainder of the basket extending through hole 11 into main body 2 transmission line 1 as shown in FIG. 2. When speaker 15 is in place, at most, the surround and top edge of the cone of the speaker may extend above the top most surface of top cover 29. The other features shown here are as described above in relation to other figures, the only difference being that here the view is from the top side of top cover 29 instead of the bottom side thereof.

FIG. 9 is a perspective view of the assembled quarter wavelength transmission line 1 of the first embodiment of the present invention, ready to receive speaker 15 in recess 19. The speaker is likely to be installed at a different work station, or facility, than the assembly of transmission line 1 as it will be necessary to provide connection between the electrical terminals of the speaker and speaker connection block 28. FIG. 9 additionally shows screws 35 that attach top cover 29 to main body 2 as described above, as well as, mounting lugs 33 which in this configuration are shown on the outer edge of top cover 29. Depending on the configuration of the location where transmission line enclosure 1 and the speaker are to be used, mounting lugs 33 could be located at a different location, e.g., to the bottom of the outer edge of the outer most tunnel wall 3 of main body 2. Up to this point the discussion has focused on the installation of a speaker having an electromagnetic motor that is controlled by an electrical signal applied thereto in the enclosure of the present invention. However in some applications one might want to place a passive radiator in recess 19 with the passive radiator activated by an active source on the air mass outside of enclosure 1.

For optimum performance the material that is used to construct main body 2 and top cover 29 need to be of sufficient thickness and rigidity at low frequencies to prevent their flexing or going into resonance. Should the material used be susceptible to either flexing or going into resonance, the tuned frequency that the length of the tunnel had been selected for could shift or vary, or create unwanted harmonic distortion. There are a number of different materials that would be acceptable for use in molding the main body 2 and top cover 29 including several plastics that, when cured, are hard and have a smooth surface.

The quarter wave speaker enclosure of the present invention is designed to receive a speaker with the axis of movement of the center of the cone oriented perpendicular to the outward expanding radius of the spiral shaped transmission tunnel which yields an enclosure that has a height that is slightly taller than the height of the basket of the speaker that is to be used with the enclosure. With the easy availability of low profile woofer speakers, the quarter wave speaker enclosure of the present invention can have an overall height of only a few inches which cannot be said for the prior art enclosures even if they incorporate a low profile speaker. Additionally, since the exterior shape of the finished enclosure of the present invention is dictated by the shape of the transmission line contained therein, the ratio of the volume of the enclosure in comparison to the volume of the air within the transmission line is very nearly unity. Further, an enclosure of the present invention that is designed for use with a 12 inch diameter speaker with a transmission line tunnel that is nearly 6 inches in width throughout the full length there of and tuned for 56 Hz will yield an enclosure that has a maximum diameter of approximately 24 inches, or twice the diameter of the speaker since the diameter of the speaker and the enclosure are in the same plane.

While FIGS. 4*a*-9 show a particular configuration of an embodiment of the spiral shaped transmission line enclosure of the present invention, the invention is not limited to the illustrated configuration. Various modifications could be made to accommodate different dimensions, ratio of heights of main body 2 to top cover 29, speakers or passive radiators with a different outline shape of the outer rim thereof, different sized speakers or passive radiators, a tunnel with a cross-sectional shape other than a square or rectangle, perhaps circular or oval, triangular or hexagonal, etc. as necessary to fit the application and location for the device of the present invention.

While the specific configurations illustrated in the figures show particular configurations and shapes of the various components and features of the invention the scope of protection afforded hereby should only be limited by the claims and equivalents of what is claimed.

What is claimed is:

1. An acoustic enclosure comprising:

a bottom portion having a substantially flat interior bottom surface;

a wall of a selected height affixed to said bottom surface and that is substantially perpendicular to said interior bottom surface wherein said wall has a first end spaced a first selected distance from a central point on said bottom surface with said wall spiraling outward from said first end with a controlled increasing radius from the central point of said bottom surface in consecutive loops of said spiral being spaced apart from each other by substantially a same selected distance at each point in the spiral defining a path between said consecutive loops of said spiral to create said wall with a selected length having a second end that is the greatest distance point of the wall from said central point;

a side wall of said enclosure formed by an outer most 360° portion of said wall; and a top portion affixed to a top edge of said wall and defining a central opening above said central point of said interior bottom surface and an area therearound substantially within said first selected distance from said central point.

2. A method of designing the shape of an acoustic enclosure comprising the steps of:

a. selecting a bottom surface;

b. affixing a wall of a selected height that is substantially perpendicular to said bottom surface wherein said wall has a first end spaced a first selected distance from a central point of said bottom surface;

C. spiraling said wall outward from said first end with a controlled increasing radius from the central point of said bottom surface with consecutive loops of said wall being spaced apart from each other by substantially a same selected distance at each point in the spiral defining a path between said consecutive loops of said wall to create said wall with a selected length having a second end that is the point on said wall that is the greatest distance from said central point with an outer most 360° portion of said wall defining a side of said enclosure;

d. shaping a top portion to be affixed to a top edge of said wall;

e. defining a central opening in said top portion to be positioned above said central point of said bottom surface and an area therearound substantially within said first selected distance from said central point; and f. affixing said top surface to a top edge of said wall.

3. The acoustic enclosure as in claim 1 wherein said central opening in said top portion is sized and shaped to receive an acoustic radiator of a similar size and shape to close said central opening having an axis of movement of a center of the acoustic radiator that is perpendicular to the controlled increasing radius of the spiraling wall.

4. The acoustic enclosure as in claim 3 is disposed to excite from within said enclosure said acoustic radiator when in place in said central opening.

5. The acoustic enclosure as in claim 1 wherein:

said top portion is disposed to receive a mounting surface of an audio speaker with said central opening sized and shaped to permit a lower portion of said audio speaker to pass therethrough and extend into said enclosure with said audio speaker sized and shaped to close said central opening; and said selected height of said wall being at least equal to a height of said lower portion of said audio speaker within said enclosure.

6. The acoustic enclosure as in claim 1 wherein said central opening of said top portion of said enclosure is disposed to receive an audio speaker therethrough with an acoustic radiator of said speaker disposed with a first surface facing out from said enclosure and a second surface facing into said enclosure and an audio motor within a lower portion of said audio speaker disposed to be within said enclosure and coupled to said second surface of said acoustic radiator.

7. The acoustic enclosure as in claim 6 wherein enclosure is disposed to position said audio speaker so that the audio motor is disposed to provide an axis of movement to a center of said acoustic radiator that is perpendicular to the controlled increasing radius of the spiraling wall.

8. The acoustic enclosure as in claim 1 wherein said path between said first end and said second end of said wall has a length equal to a multiple of a quarter wavelength of a selected frequency were said multiple is at least one and said selected frequency is in a range of frequencies producible by an audio radiator to be used with said enclosure.

9. The acoustic enclosure as in claim 1 wherein a tunnel is formed between said top and bottom portions and said wall between said first and second ends with dimensions of a cross-section of said tunnel determined by said height and shape of the wall and said selected distance between the consecutive loops with the dimensions of the cross-section selected to maximize the performance of the enclosure at a selected audio frequency.

10. The method of claim 2 wherein step e. includes the step of:

g. sizing and shaping said central opening in said top portion to receive an acoustic radiator of a similar size and shape to close said central opening having an axis of movement of a center of the acoustic radiator that is perpendicular to the controlled increasing radius of the spiraling wall.

11. The method of claim 10 further including the step of:

h. exciting from within said enclosure said acoustic radiator when in place in said central opening.

12. The method of claim 2 wherein:

step e. includes the step of:

g. sizing and shaping said central opening to receive a mounting surface of an audio speaker and to permit a lower portion of said audio speaker to pass therethrough and extend into said enclosure with said audio speaker sized and shaped to close said central opening; and step b. includes the step of:

h. selecting said height of said wall to be at least equal to a height of said lower portion of said audio speaker that extends into said enclosure.

13. The method of claim 2 wherein:

step e. further includes the step of:

g. sizing and shaping said central opening to receive an audio speaker therethrough with an acoustic radiator of said speaker disposed with a first surface facing out from said enclosure and a second surface facing into said enclosure; and step b. includes the step of:

h. selecting said height of said wall to accommodate said lower portion of said audio speaker within said enclosure with said lower portion containing an audio motor coupled to said second surface of said acoustic radiator.

14. The method of claim 13 wherein steps g. and h. dispose said enclosure to position said audio speaker so that the audio motor is disposed to provide an axis of movement to a center of said acoustic radiator that is perpendicular to the controlled increasing radius of the spiraling wall.

15. The method of claim 2 wherein step c. further includes the step of:

g. determining said selected length of said wall to provide a path having a length equal to a multiple of a quarter wavelength of a selected frequency were said multiple is at least one and said selected frequency is in a range of frequencies producible by an audio radiator to be used with said enclosure.

16. The method of claim 2 further including:

prior to step b. performing the step of:

g. determining said height of said wall; and prior to step c. performing the step of:

h. determining said controlled increasing radius and said selected distance between consecutive loops of said wall;

that creates a tunnel formed between said bottom surface, said top portion and said wall between said first and second ends;

wherein said tunnel has selected cross-section dimensions that maximize the performance of the enclosure at a selected audio frequency with said dimensions of the cross-section determined by said height of the wall and said selected distance between the consecutive loops of the wall.

17. An acoustic enclosure comprising:

a bottom portion having a substantially flat interior bottom surface;

a wall of a selected height and shape affixed to, and extending away from, said interior bottom surface of said bottom portion wherein said wall has a first end spaced a first selected distance from a central point on said bottom surface with said wall spiraling outward from said first end with a controlled increasing radius from the central point of said bottom surface in consecutive loops of said spiral being spaced apart from each other by substantially a same selected distance at each point in the spiral defining a path between said consecutive loops of said spiral to create said wall with a selected length having a second end that is the greatest distance point of the wall from said central point;

a side wall of said enclosure formed by an outer most 360° portion of said wall; and a top portion affixed to a top edge of said wall and defining a central opening above said central point of said interior bottom surface and an area therearound substantially within said first selected distance from said central point.

18. A method of designing the shape of an acoustic enclosure comprising the steps of:

selecting a bottom surface;

affixing a wall of a selected height and shape to, and extending away from, said bottom surface wherein said wall has a first end spaced a first selected distance from a central point of said bottom surface;

spiraling said wall outward from said first end with a controlled increasing radius from the central point of said bottom surface with consecutive loops of said wall being spaced apart from each other by substantially a same selected distance at each point in the spiral defining a path between said consecutive loops of said wall with a selected length having a second end that is the point on said wall that is the greatest distance from said central point with an outer most 360° portion of said wall defining a side of said enclosure;

shaping a top portion to be affixed to a top edge of said wall;

defining a central opening in said top portion to be positioned above said central point of said bottom surface and an area therearound substantially within said first selected distance from said central point; and affixing said top surface to said top edge of said wall.

* * * * *